US010246954B2

(12) United States Patent
Zhou

(10) Patent No.: US 10,246,954 B2
(45) Date of Patent: Apr. 2, 2019

(54) DRILLING APPARATUS AND METHODS FOR REDUCING CIRCULATION LOSS

(71) Applicant: Saudi Arabian Oil Company, Dhahran (SA)

(72) Inventor: Shaohua Zhou, Dhahran Hills (SA)

(73) Assignee: SAUDI ARABIAN OIL COMPANY (SA)

( * ) Notice: Subject to any disclaimer, the term of this patent is extended or adjusted under 35 U.S.C. 154(b) by 560 days.

(21) Appl. No.: 14/993,646

(22) Filed: Jan. 12, 2016

(65) Prior Publication Data

US 2016/0201410 A1 Jul. 14, 2016

Related U.S. Application Data

(60) Provisional application No. 62/102,927, filed on Jan. 13, 2015.

(51) Int. Cl.
*E21B 7/20* (2006.01)
*E21B 17/18* (2006.01)
(Continued)

(52) U.S. Cl.
CPC ..... *E21B 21/003* (2013.01); *E21B 7/20* (2013.01); *E21B 17/18* (2013.01); *E21B 21/08* (2013.01);
(Continued)

(58) Field of Classification Search
CPC . E21B 10/64; E21B 7/20; E21B 7/208; E21B 21/003; E21B 21/12; E21B 21/08;
(Continued)

(56) References Cited

U.S. PATENT DOCUMENTS 3,253,655 A * 5/1966 Brown ..... E21B 33/14 166/120
3,674,100 A * 7/1972 Becker ..... E21B 7/20 175/135
(Continued)

FOREIGN PATENT DOCUMENTS

CA 2521287 A1 4/2006
CA 2867574 A1 * 10/2013 ..... E21B 7/208
(Continued)

OTHER PUBLICATIONS

International Search Report and Written Opinion for related PCT application PCT/US2016/013200 dated Apr. 8, 2016.
(Continued)

*Primary Examiner* — Jennifer H Gay
(74) *Attorney, Agent, or Firm* — Bracewell LLP; Constance Gall Rhebergen

(57) ABSTRACT

A loss mitigation bottom hole assembly for use in a wellbore to isolate a severe loss zone of a formation, including a drill bit for drilling a well bore, and a dual wall drill string connecting the drill bit to a fluid source, and having a first fluid passage for delivering fluid to a drill bit, and a separate second fluid passage for returning the fluid away from the drill bit. The assembly further includes a drilling liner circumscribing and attached to a bottom portion of the dual wall drill string, and surrounding the drill bit, the drilling liner having an end adjacent the drill bit to contain the fluid exiting the drill bit and prevent the fluid from entering the severe loss zone of the formation.

20 Claims, 9 Drawing Sheets

(51) Int. Cl.

| | |
|---|---|
| ***E21B 21/00*** | (2006.01) |
| ***E21B 21/08*** | (2006.01) |
| ***E21B 21/10*** | (2006.01) |
| ***E21B 21/12*** | (2006.01) |
| ***E21B 47/00*** | (2012.01) |
| ***E21B 33/129*** | (2006.01) |

(52) U.S. Cl.
CPC ..... *E21B 21/103* (2013.01); *E21B 21/12* (2013.01); *E21B 33/129* (2013.01); *E21B 47/00* (2013.01)

(58) Field of Classification Search
CPC ..... E21B 21/103; E21B 33/14; E21B 33/129; E21B 33/1291; E21B 33/1295; E21B 33/12955; E21B 33/138; E21B 47/122; E21B 23/011
USPC ..... 175/171
See application file for complete search history.

(56) References Cited

U.S. PATENT DOCUMENTS 5,472,057 A * 12/1995 Winfree ..... E21B 4/02 175/101
7,134,514 B2 11/2006 Riel et al.
7,152,700 B2 12/2006 Church et al.
7,204,327 B2 4/2007 Livingstone
7,334,650 B2 * 2/2008 Giroux ..... B05B 1/00 175/26
9,057,236 B2 6/2015 Hogset et al.
9,187,968 B2 * 11/2015 Hole ..... E21B 17/18
9,816,331 B2 * 11/2017 Le ..... E21B 7/20
2003/0155156 A1 * 8/2003 Livingstone ..... E21B 17/203 175/57
2003/0183396 A1 * 10/2003 Adams ..... E21B 23/01 166/382
2004/0079553 A1 * 4/2004 Livingstone ..... E21B 7/04 175/61
2004/0124010 A1 * 7/2004 Galloway ..... E21B 7/20 175/57
2004/0216892 A1 * 11/2004 Giroux ..... E21B 7/20 166/380
2005/0274547 A1 12/2005 Fincher et al.
2007/0144784 A1 * 6/2007 Head ..... E21B 4/04 175/57
2008/0236809 A1 10/2008 Livingstone
2009/0090508 A1 * 4/2009 Brouse ..... E21B 7/20 166/289
2009/0101413 A1 * 4/2009 Abt ..... E21B 7/20 175/57
2009/0107675 A1 * 4/2009 Eriksen ..... E21B 7/20 166/285
2011/0278069 A1 * 11/2011 Ahonen ..... E21B 10/38 175/57
2012/0168178 A1 * 7/2012 Eriksen ..... E21B 17/06 166/382
2012/0181044 A1 * 7/2012 Nikiforuk ..... E21B 7/20 166/374
2012/0211279 A1 * 8/2012 Neidhardt ..... E21B 7/20 175/40
2012/0222861 A1 * 9/2012 Eriksen ..... E21B 7/20 166/290
2014/0034391 A1 * 2/2014 Eidem ..... E21B 7/20 175/57
2014/0083776 A1 * 3/2014 Hogset ..... E21B 21/10 175/57
2014/0196910 A1 * 7/2014 Le ..... E21B 7/20 166/380
2015/0136393 A1 * 5/2015 Turley ..... E21B 43/10 166/285
2015/0252639 A1 * 9/2015 Barison ..... E02D 5/46 175/57
2016/0201410 A1 * 7/2016 Zhou ..... E21B 21/003 175/40
2016/0362958 A1 * 12/2016 Zhou ..... E21B 17/1078
2016/0362959 A1 * 12/2016 Zhou ..... E21B 43/10
2017/0175468 A1 * 6/2017 Vail, III ..... E21B 21/08
2018/0150660 A1 * 5/2018 Ownby ..... E21B 34/14

FOREIGN PATENT DOCUMENTS

GB 2396870 A 7/2004
WO 2004018827 A1 3/2004
WO 2006131339 A1 12/2006
WO 2014067590 A1 5/2014
WO 2014110441 A2 7/2014

OTHER PUBLICATIONS

Long, "Emerging Drilling Technologies", Petroleum Engineering Handbook, 2006, pp. 1-6, Chapter 13, Society of Petroleum Engineers.

* cited by examiner

DRILLING APPARATUS AND METHODS FOR REDUCING CIRCULATION LOSS

CROSS-REFERENCE TO RELATED APPLICATIONS

This application claims priority to U.S. Provisional Patent Appln. No. 62/102,927, which was filed on Jan. 13, 2015, the full disclosure of which is hereby incorporated herein by reference in its entirety.

FIELD OF THE INVENTION

The present technology relates to drilling oil and gas wells. In particular, the present technology relates to drilling systems for use in reducing circulation loss using a dual-walled drill string capable of simultaneously drilling and lining loss zones.

BACKGROUND OF THE INVENTION

In oil and gas drilling operations, hydrocarbon producing wellbores extend subsurface and intersect subterranean formations where hydrocarbons are trapped. The wellbores generally are created by drill bits attached to the end of a drill string, where typically a drive system above the opening to the wellbore rotates the drill string and bit. Drill bits are usually equipped with cutting elements that scrape the bottom of the wellbore as the bit is rotated to excavate material from the formation, thereby deepening the wellbore. Drilling fluid, also referred to as drilling mud, is typically pumped down the drill string and directed from the drill bit into the wellbore, where it then flows back up the wellbore in an annulus between the drill string and walls of the wellbore. The drilling fluid cools the bit, maintains a desired pressure in the well, and when flowing up the wellbore carries with it cuttings produced during drilling operations.

Safe and efficient hydrocarbon well drilling practices are essential in the oil and gas industry. Among the most costly and challenging problems encountered in the industry involves the occurrence of lost circulation zones or "loss zones" in a wellbore. This phenomenon generally results from the drilling fluid flowing from the wellbore into the subterranean formations where the hydrocarbons of may be trapped. The resulting reduction or loss of flow in a well affected by lost circulation, which can exceed 100 bbl/hr, is detrimental in terms of both the financial loss and the resulting safety concerns, which may include the potential loss of well control. The elimination or alleviation of lost circulation zones is a priority for the industry, as billions of dollars are lost per year due to lost circulation in drilling operations through losses of drilling fluids, formation damage (e.g., if losses occur include reservoir section) and its negative impact on hydrocarbon production, and the costs of addressing the phenomenon through, e.g. lost circulation materials (LCMs). In further consideration of the relevant potential environmental and regulatory issues, the prevention and remediation of circulation loss in drilling operations is highly desirable.

SUMMARY OF THE INVENTION

One embodiment of the present technology provides a loss mitigation bottom hole assembly for use in a wellbore in a severe loss zone of a formation. The assembly includes a drill bit for drilling a well bore, and a dual wall drill string connecting the drill bit to a fluid source, and having a first fluid passage for delivering fluid to a drill bit, and a separate second fluid passage for returning the fluid away from the drill bit. In addition, the assembly includes a drilling liner circumscribing and attached to a bottom portion of the dual wall drill string, and surrounding the drill bit, the drilling liner having an end (such as a commonly known drill-shoe with rock cutting elements) adjacent the drill bit to contain the fluid exiting the drill bit and prevent the fluid from entering the severe loss zone of the formation.

In some embodiments, the assembly can further include a liner running/setting tool for setting the drilling liner relative to a casing when the drilling liner reaches a desired location in the well bore bridging the severe loss zone of the formation. The liner running/setting tool can include a collet retainer nut circumscribing the dual wall drill string and moveable between a first position and a second position axially relative to the dual wall drill string, and a collet retainer nut activation mechanism controllable by an operator to move the collet retainer nut between the first position and the second position. Furthermore, the liner running/setting tool can include a packer element circumscribing the drilling liner and in mechanical communication with the collet retainer nut, the packer element in an unenergized state when the collet retainer nut is in the first position, and in an energized state when the collet retainer nut is in the second position, so that when the collet retainer nut activation mechanism moves the collet retainer nut from the first position to the second position, the packer element is energized and seals the space between the drilling liner and the casing, and a toothed liner hanger slip circumscribing the drilling liner and in mechanical communication with the packer element, the toothed liner hanger slip disengaged from the casing when the packer element is not energized, and lockingly engaged with the casing when the packer element is energized, the toothed liner hanger slip preventing relative movement between the drilling liner and the casing when lockingly engaged with the casing. In addition, the packer element can have an angled surface positioned for forced insertion between the drilling liner and the toothed liner hanger slip when the packer element is energized, the angled surface pushing a portion of the toothed liner hanger slip into engagement with the casing when the packer element is energized.

In some embodiments, the loss mitigation bottom hole assembly can include a fluid return area adjacent the drill bit between the dual wall drill string and the drilling liner, the fluid return area receiving fluid exiting from the drill bit, and a cross-over port assembly providing fluid communication between the fluid return area and the second fluid passage. The cross-over port assembly can include a valve having a first end and a second end, and movable between an open position and a closed position, and a passage between the fluid return area and the second fluid passage bisected by the valve, the first end of the valve in pressure communication with the first fluid passage and the second end of the valve in pressure communication with the fluid return area, so that when pressure in the first fluid passage exceeds pressure in the fluid return area, the valve moves toward the open position.

An alternate embodiment of the present technology includes a liner running/setting tool for setting a drilling liner relative to a casing adjacent a severe loss zone of a well, including a collet retainer nut circumscribing a drill string in a well and moveable between a first position and a second position axially relative to the drill string, and a collet retainer nut activation mechanism controllable by an operator to move the collet retainer nut between the first position and the second position. The tool further includes a packer element circumscribing the drilling liner and in mechanical communication with the collet retainer nut, the packer element in an unenergized state when the collet retainer nut is in the first position, and in an energized state when the collet retainer nut is in the second position, so that when the collet retainer nut activation mechanism moves the collet retainer nut from the first position to the second position, the packer element is energized and seals the space between the drilling liner and the casing. In addition, the tool further includes a toothed liner hanger slip circumscribing the drilling liner and in mechanical communication with the packer element, the toothed liner hanger slip disengaged from the casing when the packer element is not energized, and lockingly engaged with the casing when the packer element is energized, the toothed liner hanger slip preventing relative movement between the drilling liner and the casing when lockingly engaged with the casing.

In some embodiments, the packer element can have an angled surface positioned for forced insertion between the drilling liner and the toothed liner hanger slip when the packer element is energized, the angled surface pushing a portion of the toothed liner hanger slip into engagement with the casing when the packer element is energized. In addition, the collet retainer nut activation mechanism can be a pump that applies hydraulic pressure to a surface of the collet retainer nut to push the collet retainer nut from the first position toward the second position.

In alternate embodiments, the liner running/setting tool can further include a collet fixedly attached to the drill string, the collet fixedly engaged with the drilling liner when the collet retainer nut is in the first position, and releasably engaged with the drilling liner when the collet retainer nut is in the second position. In addition, the tool can include a pressure equalization passage fluidly connecting an area above the liner running/setting tool with an area below the running/setting tool to equalize pressure above and below the running/setting tool, as well as a check valve in the pressure equalization passage to open and close the pressure equalization passage to fluid communication.

Another embodiment of the present technology provides a loss mitigation bottom hole assembly for use in a wellbore in a severe loss zone of a formation, including a drill bit for drilling a well bore, a dual wall drill string connecting the drill bit to a fluid source, and having a first fluid passage for delivering fluid to a drill bit, and a separate second fluid passage for returning the fluid away from the drill bit, a drilling liner circumscribing and attached to a bottom portion of the dual wall drill string, and surrounding the drill bit, the drilling liner having an end adjacent the drill bit to contain the fluid exiting the drill bit and prevent the fluid from entering the severe loss zone of the formation, a fluid return area adjacent the drill bit between the dual wall drill string and the drilling liner, the fluid return area receiving fluid exiting from the drill bit, and a cross-over port assembly providing fluid communication between the fluid return area and the second fluid passage. The cross-over port assembly includes a valve having a first end and a second end, and movable between an open position and a closed position, and a passage between the fluid return area and the second fluid passage bisected by the valve, the first end of the valve in pressure communication with the first fluid passage and the second end of the valve in pressure communication with the fluid return area, so that when pressure in the first fluid passage exceeds pressure in the fluid return area, the valve moves toward the open position.

In some embodiments, the cross-over port assembly can further include a biasing mechanism in contact with the valve to bias the valve toward either the open or the closed position. In addition, the passage of the cross-over port assembly between the fluid return area and the second fluid passage can bisect the first fluid passage.

Yet another embodiment of the present technology provides a method to control lost circulation in a severe loss zone in a subsurface formation. The method includes the steps of (a) drilling a well bore in the subsurface formation using a first bottom hole assembly until the well bore reaches a severe loss zone in the formation, (b) removing the first bottom hole assembly from the well bore, (c) running a second bottom hole assembly into the well bore, the second bottom hole assembly including a dual wall drill string, a drill bit, and a drilling liner extending to the end of the drill bit, (d) drilling through the severe loss zone using the second bottom hole assembly so that the drilling liner progresses through the severe loss zone along with the drill bit and prevents drilling fluid from entering the formation in the severe loss zone, and (e) removing the second bottom hole assembly from the well bore.

In some embodiments, second bottom hole assembly includes a dual wall drill string assembly. In addition, the method can further include the steps of (f) setting the drilling liner relative to a casing in the well bore above the severe loss zone prior to step (e), and initiating step (f) by introducing a radio frequency identification (RFID) tag into the well to communicate with an RFID detector in the second bottom hole assembly. Furthermore, the method can include the step of running the first bottom hole assembly into the well to continue boring the well below the severe loss zone.

BRIEF DESCRIPTION OF THE DRAWINGS

So that the manner in which the features and advantages of the present technology, as well as others which will become apparent are attained and can be understood in more detail, a more particular description of the present technology briefly summarized above may be had by reference to the embodiments thereof which are illustrated in the appended drawings, which drawings form a part of this specification. It is to be noted, however, that the drawings illustrate only embodiments of the present technology and, therefore, are not to be considered limiting of its scope as the present technology may admit to other equally effective embodiments.

DETAILED DESCRIPTION OF THE INVENTION

Embodiments of the present technology will now be described more fully hereinafter with reference to the accompanying drawings, which illustrate embodiments of the present technology. This technology may, however, be embodied in many different forms and should not be construed as limited to the illustrated embodiments set forth herein; rather, these embodiments are provided so that this disclosure will be thorough and complete, and will fully convey the scope of the present technology to those skilled in the art. Like numbers refer to like elements throughout.

In preferred embodiments, the present technology can advantageously control lost circulation in a lost circulation zone in a wellbore. For instance, one embodiment of the present technology (described in greater detail below) enables the circulation of drilling mud and/or drilling fluid with drill cuttings returned to the top of the drill string through the inner string. This embodiment advantageously avoids the active circulation of any drilling mud, drilling fluid, and drill cuttings in the outer string or annulus, with the exception of a drilling fluid optionally circulated in an area where a drilling liner is operably set for controlling adjacent loss circulation zones. As will be understood by those skilled in the art, certain embodiments of the present technology, for example, also can reduce financial loss, safety concerns, regulatory issues and environmental impact.

Figure 1:
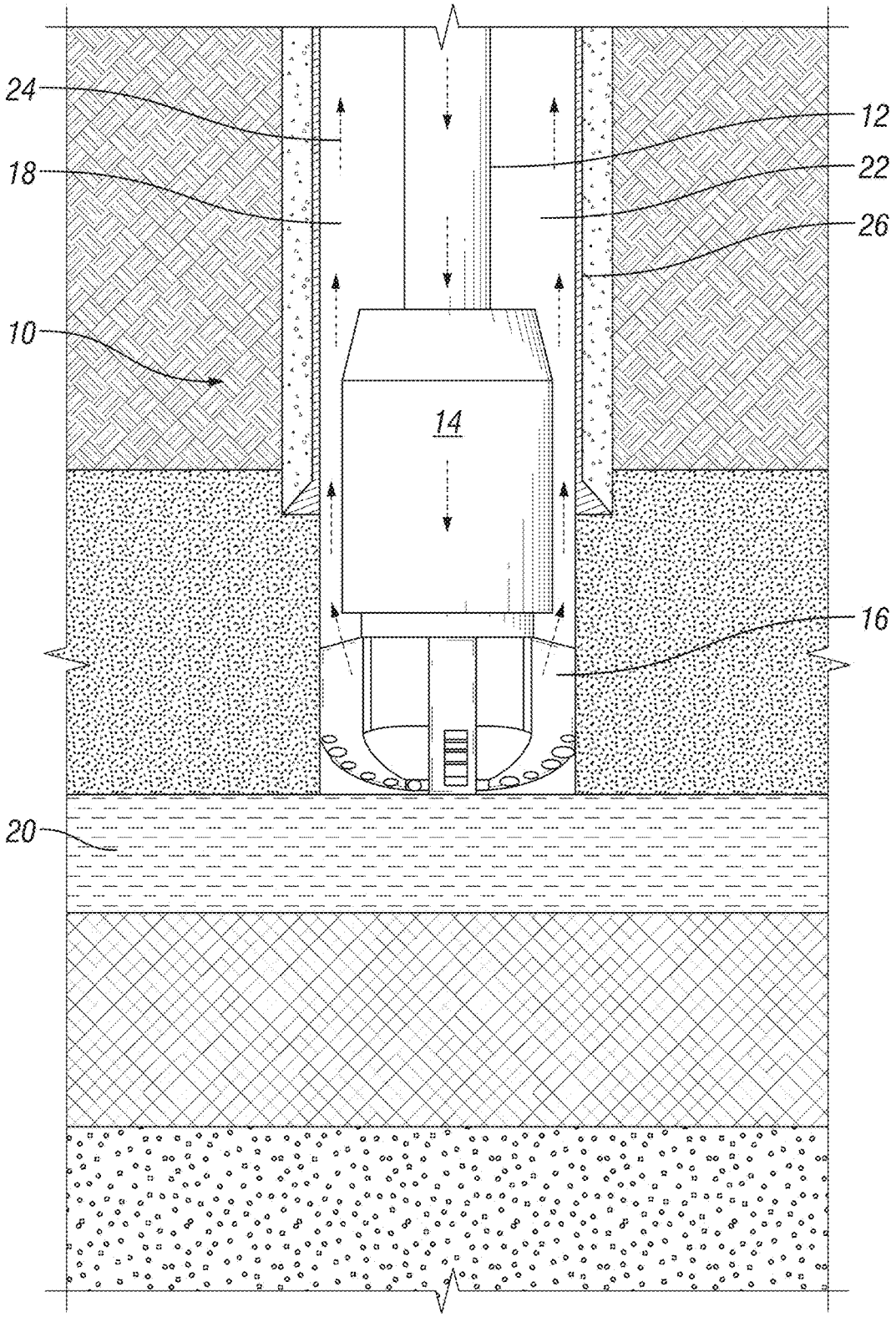
FIG. 1 is a side cross-sectional view of a drilling system, according to an embodiment of the present technology, as the drill bit approaches a lost circulation zone.
Figure 2:
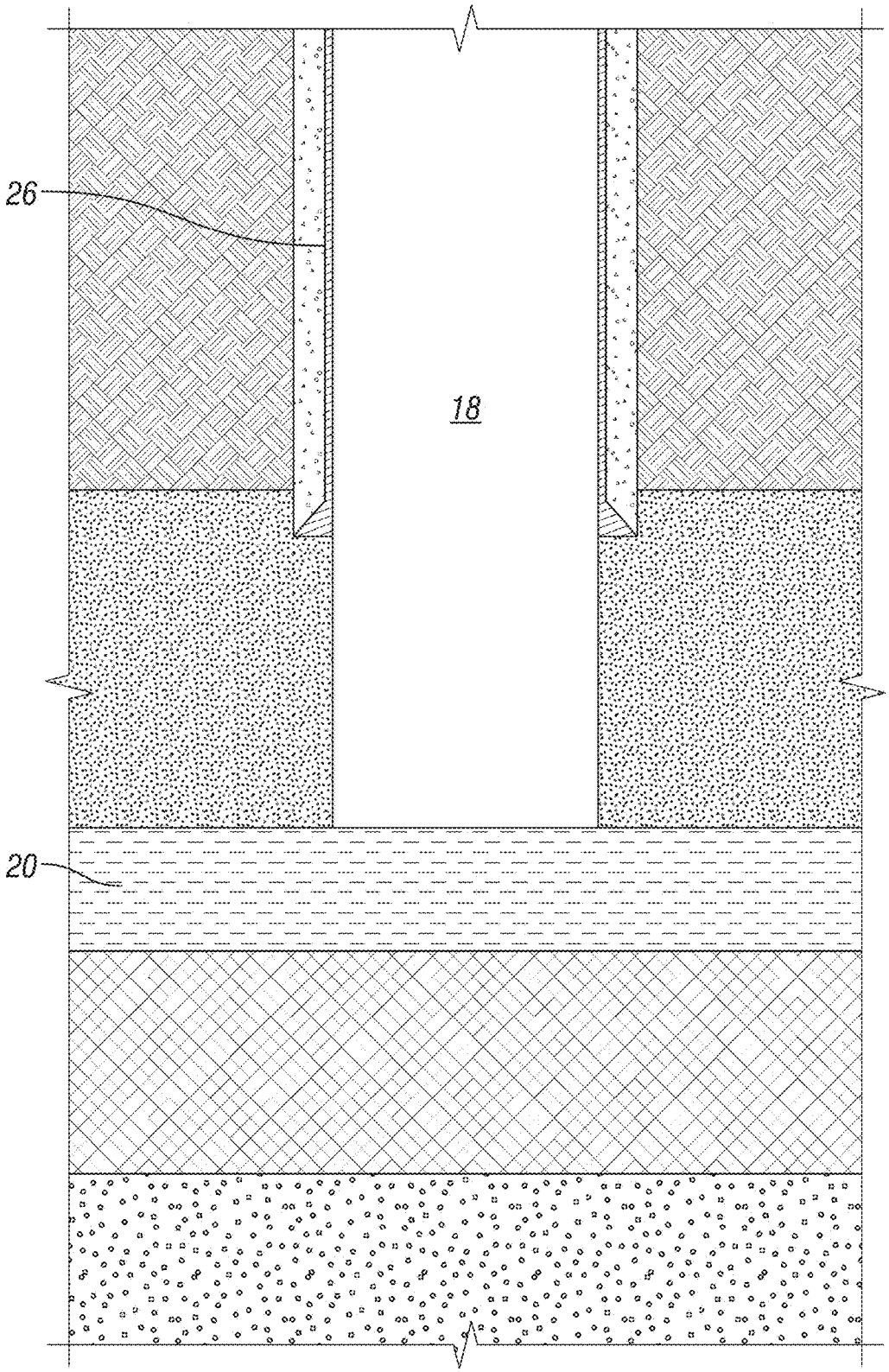
FIG. 2 is a side cross-sectional view of a well bore after drilling equipment is pulled from the well and before an apparatus of the present technology is inserted.

Referring now to the drawings, there is shown in FIG. 1 a step of a method, according to an embodiment of the present technology. According to the step shown in FIG. 1, a bottom hole assembly (BHA) 10 that includes a drill string 12, a mud motor 14, and a drill bit 16, can drill the well bore 18 according to known techniques, until the drill bit 16 reaches near the top of a severe loss zone 20 in the formation. During this initial step, drilling fluid can flow down through the drill string 12, through the mud motor 14, out the drill bit 16, and back up the annulus 22 of the well bore 18, according to the path 24. In addition, during this initial step, a well casing 26 can be installed in the well bore 18 above the severe loss zone 20. Next, as shown in FIG. 2, the BHA 10 can be withdrawn from the well bore 18 in preparation for the introduction of a loss mitigation BHA 28 (shown in FIG. 3).

Figure 3:
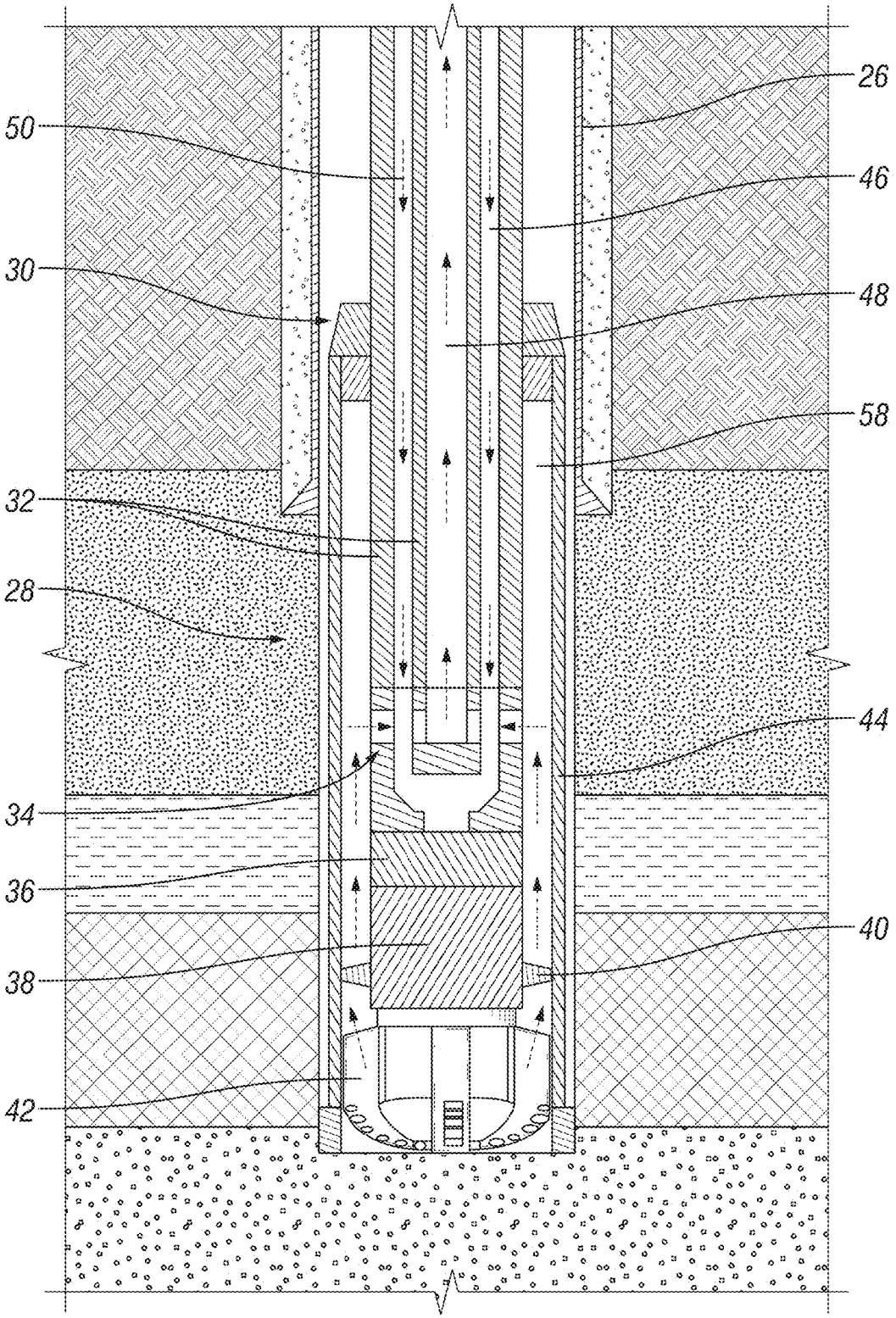
FIG. 3 is a side cross-sectional view of a drilling system according to an embodiment of the present technology, with the drill bit and lining bridging the lost circulation zone.

Referring to FIG. 3, there is shown a loss mitigation BHA 28, according to an embodiment of the present technology. The loss mitigation BHA 28 is designed to bridge the severe loss zone 20 and prevent or reduce the loss of drilling fluid into the formation as the drill bit passes through the sever loss zone 20. The loss mitigation BHA 28 can include a rotating liner running/setting tool 30, a dual wall drill string 32, a flow cross-over port assembly 34, a slip joint 36 or hydraulic thruster, a mud motor 38, stabilizers 40, a drill bit 42, and a tight-clearance drilling liner 44. The loss mitigation BHA 28 provides a structure capable of both drilling through the sever loss zone 20 using the drill bit 42, and inserting a lining 44 into the well bore to prevent egress of drilling fluid from the loss mitigation BHA 28 into the formation, simultaneously. Each principle component of the loss mitigation BHA 28 will now be described in detail.

The dual wall drill string 32 contains both an outer fluid passage 46, and an inner fluid passage 48. In the embodiment shown, drilling fluid travels along path 50 down the outer fluid passage 46 to the drill bit 42 where it is expelled to help cool the drill bit 42 and to carry cuttings and other debris away from the drill bit 42. From the drill bit 42, the drilling fluid travels back upward inside the drilling liner 44 to the flow cross-over port assembly 34 (described in greater detail below with regard to FIGS. 4A and 4B). The drilling fluid enters the inner fluid passage 48 of the dual wall drill string 32 via the flow cross-over port assembly 34, and travels away from the drill bit 42 toward the top of the well. Use of the dual wall drill string 32 in the loss mitigation BHA 28 allows for the components of the loss mitigation BHA 28 to form a substantially closed system 28, thereby reducing the ability of drilling fluid to enter the formation in the severe loss zone 20.

The slip joint 36 connects that bottom of the dual wall drill string 32 to the mud motor 38, and the mud motor 38 pumps the drilling fluid to the drill bit 42. The mud motor 38 thus serves to help circulate the drilling fluid through the loss mitigation BHA 28. The drill bit 42 is attached to the mud motor 38, and rotates to cut into the formation and extend the well bore 18. The drill bit 42 heats as it rotates, in large part because of the friction between the drill bit 42 and elements that make up the formation. The flow of drilling fluid helps to cool the drill bit 42 as it rotates. In addition, as the drill bit cuts into the formation, it generates cuttings and other debris. The drilling fluid helps to carry away such cuttings and debris generated by the drill bit 42.

The drilling liner 44 surrounds the other components of the loss mitigation BHA 28, and progresses through the well bore 18 along with the drill bit 42 as the drill bit 42 cuts the well bore 18. At its upper end, the drilling liner 44 surrounds the dual wall drill string 32, with components of the liner running/setting tool 30 covering the gap and providing a seal between the drilling liner 44 and the dual wall drill string 32. This seal contains the drilling fluid within the loss mitigation BHA 28 as it flows from the drill bit 42 to the flow cross-over port assembly 34, and blocks the fluid from communicating with the annulus 22 of the well bore 18. Such containment is beneficial to provide the hydraulic forces that control of the cross-over port assembly 34, as discussed in detail below. In addition to the above, the drilling liner 44 is rotated as it progresses during the drilling operation. Such rotation causes a plastering or smearing effect on the walls of the bore through the severe loss zone, which helps to further seal the walls of the well bore to that drilling fluid is not lost into the formation.

For simplicity, the running/setting tool 30 is shown only schematically in FIG. 3. The running/setting tool 30 is shown in greater detail in FIGS. 5A-5C. By enclosing the loss mitigation BHA 28, including the drilling fluid, and progressing down the well bore along with the drill bit 42, the drilling liner 44 substantially prevents the drilling fluid from entering the formation at the sever loss zone 20. Once the loss mitigation BHA 28 has been inserted into the well bore 18 so that the drilling liner 44 bridges the severe loss zone 20, the drilling liner 44 can be set relative to the hanger using the running/setting tool 30 (as described in greater detail below with regard to FIGS. 5A-5C).

Figure 4A:
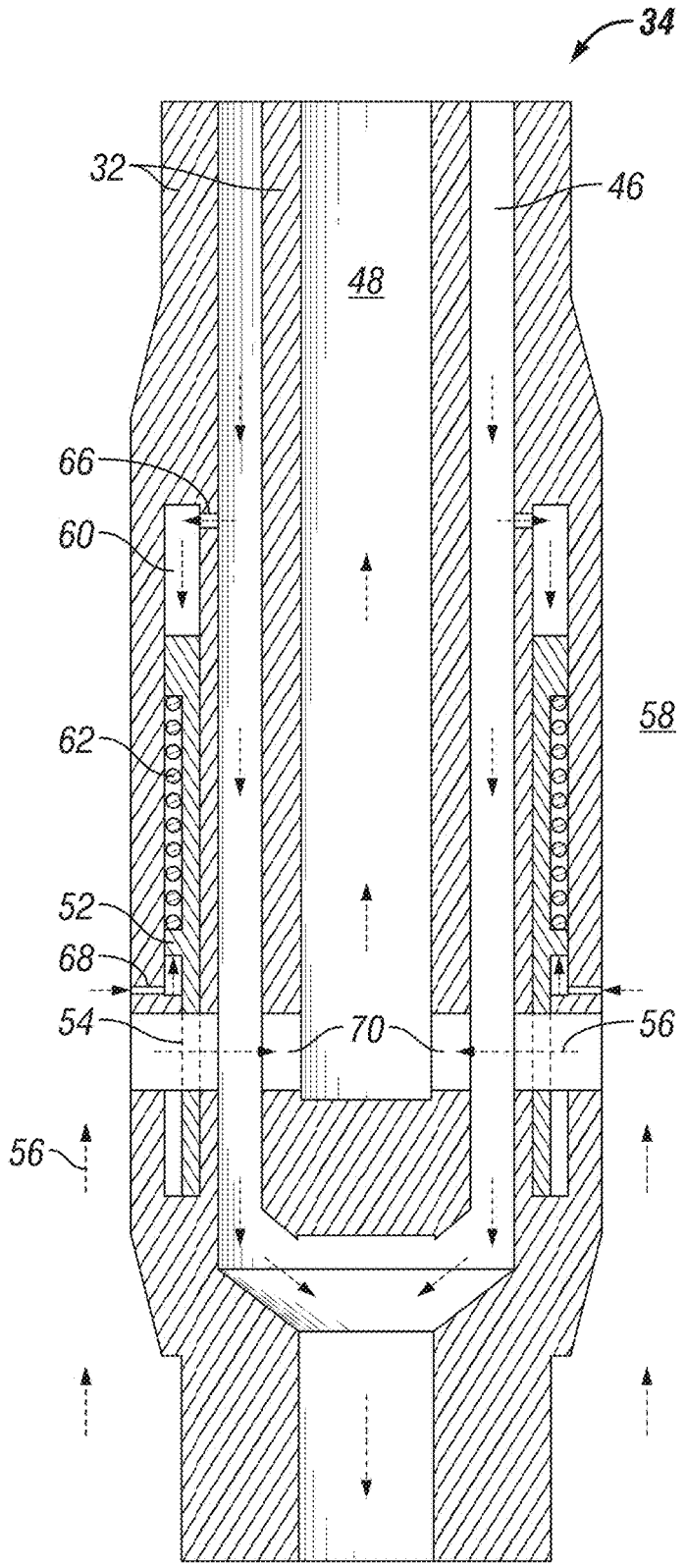
FIG. 4A is a side cross-sectional view of a flow cross-over port for use in the drilling system of FIG. 3, according to an embodiment of the present technology, where the flow control valve is in the open position.

FIG. 4A shows an enlarged cross-sectional view of the flow cross-over port assembly 34, including the valve 52 and valve openings 54. As shown, valve openings 54 provide a fluid path 56 between an area 58 outside of the dual wall drill string 32, and the inner fluid passage 48 of the dual wall drill string 32. The valve 52 can be positioned in a recess 60 in a wall of the dual wall drill string 32, and can be configured to translate axially in the recess 60 between an open position (shown in FIG. 4A) and a closed position (shown in FIG. 4B). In some embodiments, the valve 52 can have a spring 62 or other biasing mechanism to help push the valve 52 toward the open or the closed position.

Figure 4B:
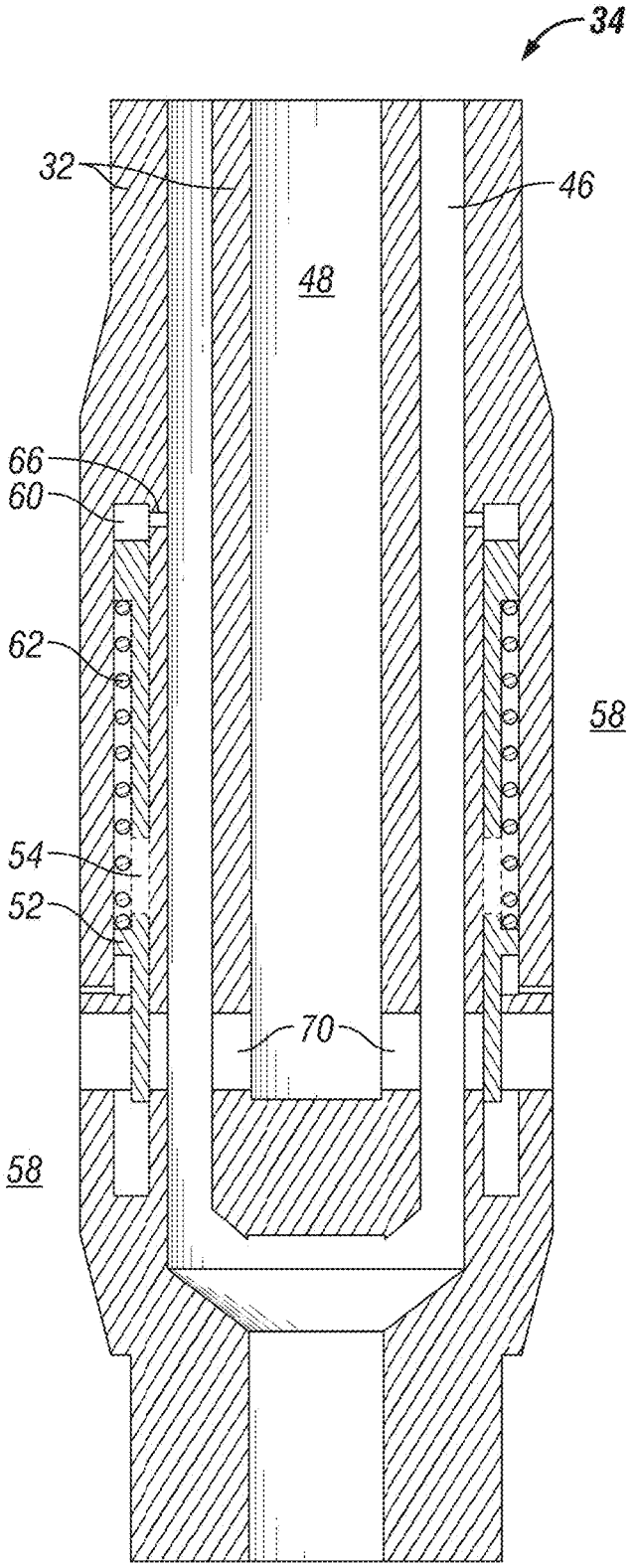
FIG. 4B is a side cross-sectional view of the flow cross-over port of FIG. 4A, where the flow control valve is in the closed position.

Also shown in FIGS. 4A and 4B are hydraulic ports 66, 68. Hydraulic port 66 provides pressure communication between an upper end of the valve 52 and the drilling fluid in the outer fluid passage 46 of the dual wall drill string 32. Small hydraulic hole or port 68 provides pressure communication or ventilation between a lower end of the valve 52 and the area 58 outside the dual wall drill string 32. Thus, the valve 52 is balanced by the pressure in the outer fluid passage 46 and the pressure in the area 58 outside the dual wall drill string 32.

As shown in FIG. 4A, when the pressure in the outer fluid passage 46 of the dual wall drill string 32 exceeds the pressure in the area 58 outside the dual wall drill string 32, a pressure differential develops across the valve 52, overcomes the force of spring 62, and the valve 52 moves downward in the recess 60 toward an open position. When in such open position, the valve opening 54 substantially aligns with a passage 70 between the inner fluid passage 48 and the area 58 outside the dual wall drill string 32, so that fluid can flow into the inner fluid passage 48 from area 58. Since pressure in the outer fluid passage 46 will be highest when drilling fluid is being pumped down the well, this means that the valve 52 will be open when fluid is circulating through the loss mitigation BHA 28.

Conversely, as shown in FIG. 4B, when fluid circulation through the loss mitigation BHA 28 is stopped and pump pressure is bled off at the surface, the pressure in the area 58 outside the dual wall drill string 32 substantially equalizes with the pressure in the outer fluid passage 46, and a little pressure differential develops across the valve 52, so that the compressed force from bias spring 62 will be released that moves the valve 52 upward in the recess 60 toward a closed position. When in such closed position, the valve opening 54 is not aligned with the passage 70 between the inner fluid passage 48 and the area 58 outside the dual wall drill string 32, so that fluid is prevented from flowing into the inner fluid passage 48 from area 58.

Figure 5A:
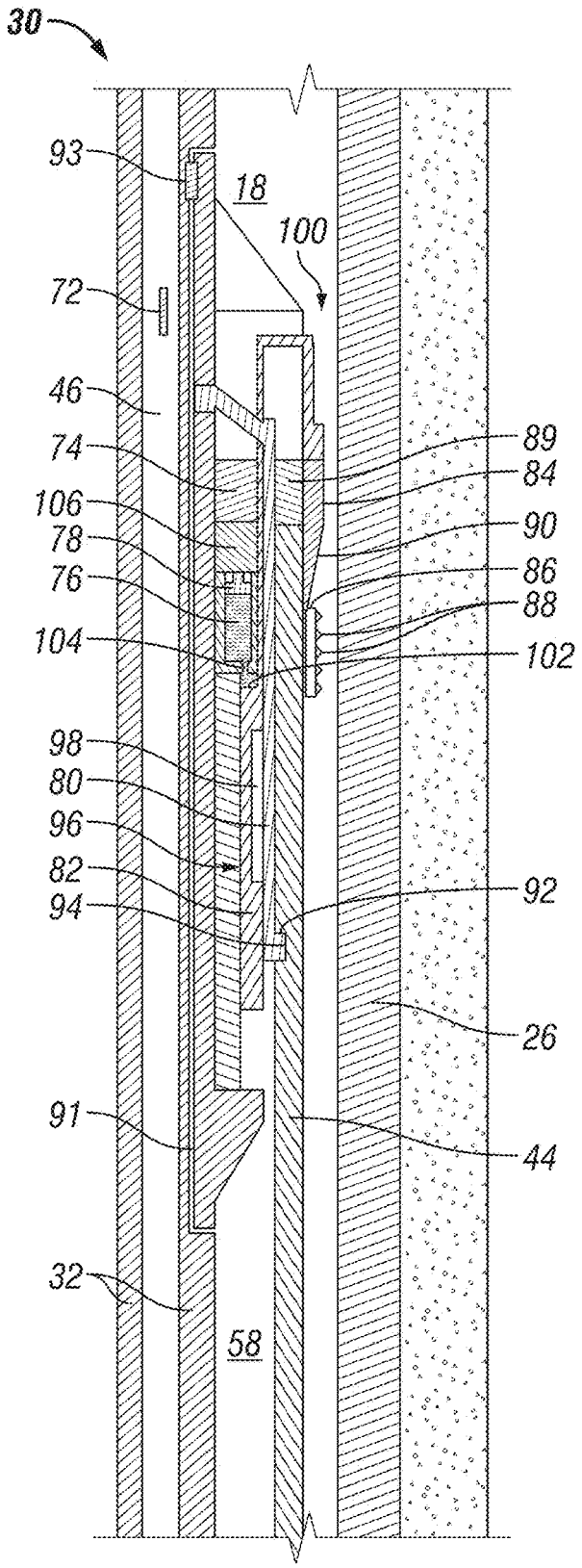
FIG. 5A is a partial side cross-sectional view of a rotating liner setting tool for use in the drilling system of FIG. 3, according to an embodiment of the present technology.
Figure 5B:
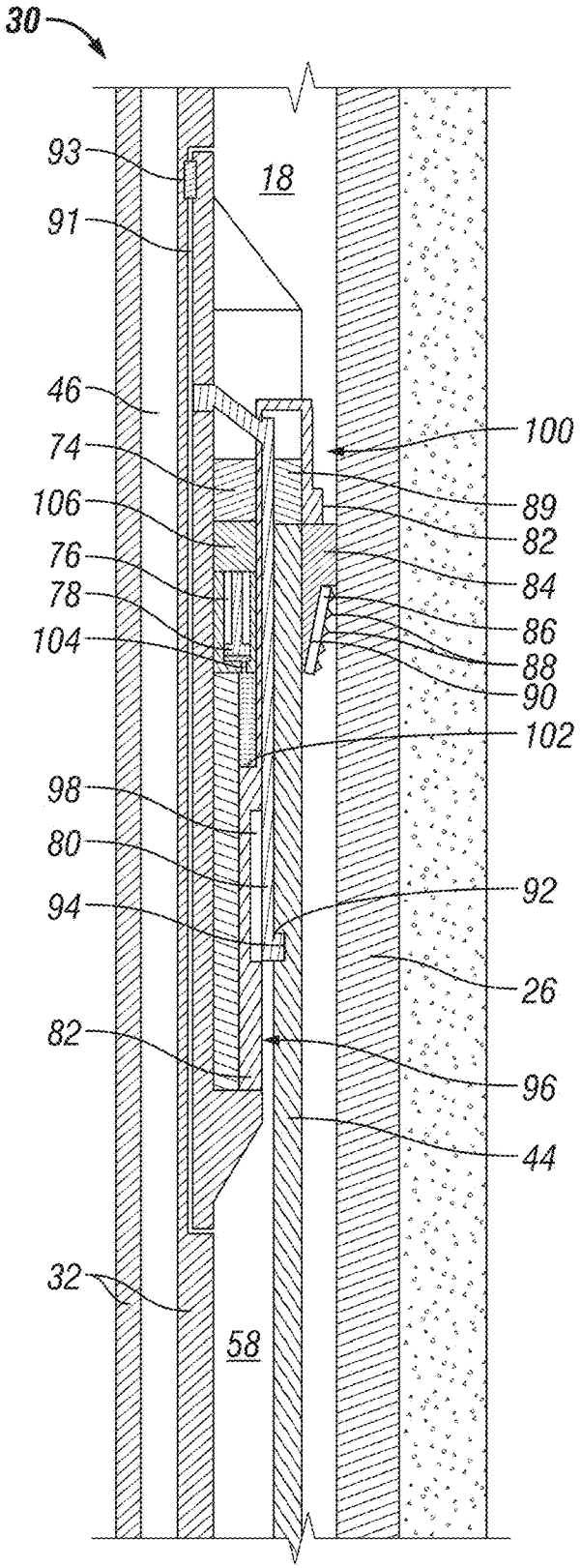
FIG. 5B is a partial side cross-sectional view of the rotating liner setting tool of FIG. 5A, with a gripping mechanism of the drilling liner engaged with a well casing.

FIGS. 5A and 5B show details of the running/setting tool 30 at different stages it sets the drilling liner 44 relative to the casing 26. Specific components that can be included in the example embodiment shown include a radio frequency identification (RFID) tag 72, an RFID detector 74, a hydraulic chamber 76 that may contain a piston 78 and isolated piston fluid, a collet 80, a collet retainer nut 82, a packer element 84, and a liner hanger slip 86. The liner hanger slip 86 can have teeth 88 for engaging the casing 26. Also shown in FIGS. 5A and 5B is a clutch mechanism 89, and a pressure equalization passage 91 with a check valve 93. The clutch mechanism can be used to engage the dual wall drill string 32 with the top of the drilling liner 44 to enable transmission of rotating torque from the surface to rotate the drilling liner 44 for the purpose of achieving liner drilling. The pressure equalization passage 91 can help to equalize pressure between the well annulus 18 and the area 58 inside the drilling liner 44, and can be opened or closed using the check valve 93.

Referring specifically to FIG. 5A, the running/setting tool 30 is shown in a disengaged state, as it would be while the running/setting tool 30 is traveling down the well to its intended location near the severe loss zone 20. While is such a disengaged state, the liner hanger slip 86 is substantially aligned with the drilling liner 44 so that the teeth 88 are separated from the casing 26. The packer element 84 is located above the liner hanger slip 86, and has an angled surface 90 positioned so that when the packer element is pushed downward relative to the drilling liner 44, the angled surface 90 wedges in the interface between the liner hanger slip 86 and the drilling liner 44, and pushes one end of the liner hanger slip 86 forward until the teeth 88 engage the casing 26 (as shown, for example, in FIG. 5B). Also while in the disengaged state, the collet 80 engages the drilling liner 44 by means of a protrusion 92 that extends into a corresponding recess 94 in the hanger. The collet 80 is held in place, with the protrusion 92 engaging the recess 94, by the collet retainer nut 82.

The collet retainer nut 82 is movable between a first position (shown in FIG. 5A) and a second position (shown in FIG. 5B). In addition, the collet retainer nut 82 has two ends that perform separate but simultaneous functions. The first end 96 of the collet retainer nut 82 is located near the protrusion 92 of the collet 80, and includes a recess 98. When the collet retainer nut 82 is in the first position, shown in FIG. 5A, the recess 98 is not aligned with the protrusion 92. Instead, the body of the collet retainer nut 82 abuts the collet 80 so that the protrusion 92 is held firmly in place in the recess 94 of the drilling liner 44. Conversely, when the collet retainer nut 82 is in the second position, shown in FIG. 5B, the recess 98 aligns with the collet 80 such that the end of the collet 80 can flex inward, thereby allowing the protrusion 92 to disengage from the recess 94 of the drilling liner 44.

The second end 100 of the collet retainer nut 82 is located above the packer element 84. When the collet retainer nut 82 is in the first position, shown in FIG. 5A, the second end 100 of the collet retainer nut 82 abuts the packer element 84 while the packer element is positioned above the liner hanger slip 86, as discussed above. Conversely, when the collet retainer nut 82 is in the second position, shown in FIG. 5B, the second end 100 of the collet retainer nut 82 pushes the packer element 84 downward so that the angled surface 90 of the packer element 84 wedges behind the liner hanger slip 86, also as discussed above. Such action pushes the teeth 88 of the liner hanger slip into engagement with the casing 26.

The position of the collet retainer nut 82 between the first position and the second position can be controlled by hydraulic pressure in the hydraulic chamber 76. Pressure communication is provided between the hydraulic chamber 76 and a shoulder 102 on the collet retainer nut 82 via a port 104. As hydraulic pressure in the hydraulic chamber 76 and port 104 increases, such pressure applies a downward force on the shoulder 102, thereby pushing the collet retainer nut 82 from the first position toward the second position. Hydraulic pressure in the hydraulic chamber 76 and port 104 can be controlled by any appropriate means, such as, for example, an electric pump 106 which may use a piston 78 or other means to increase or decrease pressure in the hydraulic chamber 76 and port 104.

To determine when to set the drilling liner 44 relative to the casing 26, one embodiment of the present technology includes use of the RFID tag 72 and detector 74. The RFID detector can be attached to, or embedded as part of, the running/setting tool 30. When an operator desires to set the drilling liner 44, the operator can send the RFID tag 72 down the outer fluid passage 46 of the dual wall drill string 32. When the RFID tag reaches a predetermined proximity to the RFID detector 74, the RFID detector 74 can instruct the electric pump 106 to increase hydraulic pressure in the hydraulic chamber 76 and port 104 to move the collet nut retainer 82 from the first position toward the second position.

The process of setting the drilling liner 44 relative to the casing 26 includes running the running/setting tool 30 into the well with the loss mitigation BHA 28 until the loss mitigation BHA 28 reaches a desired location in the well. This location typically corresponds to the bridging of a severe loss zone by the drilling liner 44. Then, the RFID tag 72 can be deployed to instruct the RFID detector, which in turn triggers the electric pump 106 to set the drilling liner 44.

To set the drilling liner 44, the electric pump 106 can increase the hydraulic pressure in the hydraulic chamber 76 and the port 104 via the movement of piston 78. This will move the collet nut retainer 82 from the first position toward the second position. As the collet nut retainer 82 moves from the first position toward the second position, the recess 98 in the collet net retainer 82 aligns with the end of the collet 80, adjacent the protrusion 92. At the same time the second end 100 of the collet nut retainer 82 pushes the packer element 84 downward. As the packer element 84 moves downward, the angled surface 90 inserts between the liner hanger slip 86 and tilts the liner hanger slip 86 toward the casing 26 until the teeth 88 of the liner hanger slip 86 engage the casing 26. With the teeth so engaged, the drilling liner 44 is set relative to the casing 26. As the packer element 84 moves downward, it also expands to seal the gap between the drilling liner 44 and the casing 26, as shown in FIG. 5B.

Figure 5C:
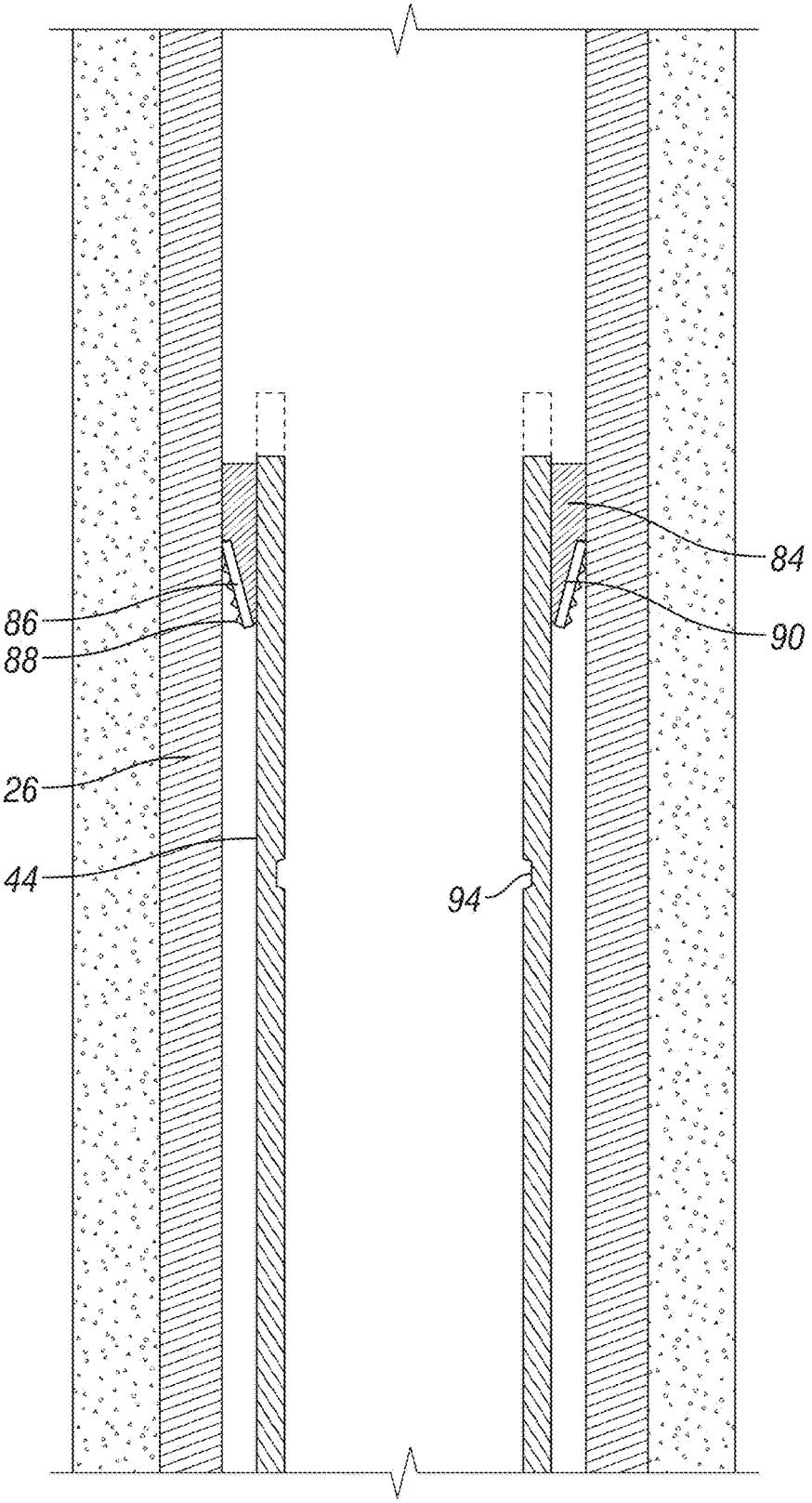
FIG. 5C is a side cross-sectional view of a well casing and drilling liner according to an embodiment of the present technology, with the drilling liner set relative to the casing and the rotating liner setting tool removed from the well bore.

Once the hanger 44 is set relative to the casing 26, and the packer element is energized to seal the gap between the hanger 44 and the casing 26, the running/setting tool 30 can be withdrawn from the well. To accomplish this, the dual wall drill string 32 is pulled out of the well bore. As the dual wall drill string 32 is lifted, the end of the collet 80 deflects inwardly into the recess 98 of the collet nut retainer 82 and the protrusion 92 disengages from the recess 94 in the drilling liner 44. As shown in FIG. 5C, all of the components but the drilling liner 44, liner hanger slip 86, and packer element 84 can be removed from the well.

Figure 6:
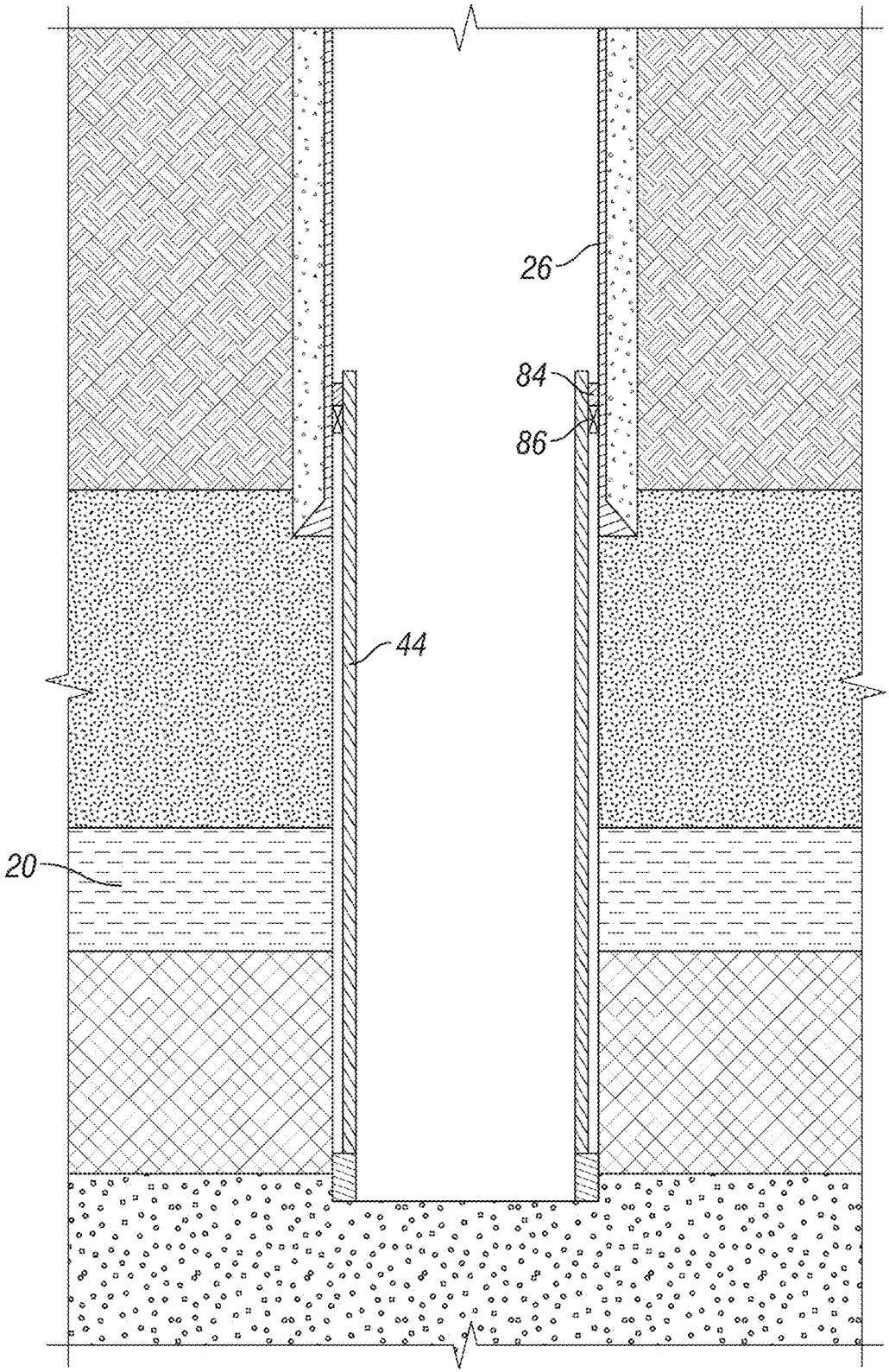
FIG. 6 is a side cross-sectional view of the wellbore after the lining of the present technology has been inserted across the lost circulation zone.

FIG. 6 shows the completed well bore after the running/setting tool 30 and loss mitigation BHA 28 components have been removed from the well. As shown, the drilling liner 44 is in place bridging the severe loss zone 20 and is set and sealed relative to the casing 26 at the upper end of the drilling liner 44. The bottom end of the drilling liner 44 is positioned below the severe loss zone 20 and remains open so that regular drilling operations can continue to extend the depth of the well bore if desired.

Certain embodiments contemplate use of the present technology for the deployment of a tight-clearance drilling liner in a well for isolating a severe less zone in a most time efficient manner without losing much resulting hole size available for the continued drilling of the next hole section. A skilled artisan will appreciate that such drilling and subsurface wellbore formation will advantageously require less cement, mud, drilling fluid and downhole casing and tubing, thereby reducing operational, drilling and material costs.

In some embodiments of the present technology, the drilling liner 44 can any commercially available drilling liner, for instance 1) a 16 inch drilling liner for use below an 18⅝ inch casing show, b) an 11¾ inch drilling liner for use below a 13⅜ inch casing shoe, and c) an 8 inch drilling liner for use below a 9⅝ inch casing shoe, while the dual wall drill string 32 can be standard 6⅝ inch and or 5½ inch drillpipe with a smaller connectable inner tube.

Many modifications and other embodiments of the technology will come to the mind of one skilled in the art having the benefit of the teachings presented in the foregoing descriptions and the associated drawings. Therefore, it is to be understood that the technology is not to be limited to the illustrated embodiments disclosed, and that modifications and other embodiments are intended to be included within the scope of the appended claims.

Unless defined otherwise, all technical and scientific terms used have the same meaning as commonly understood by one of ordinary skill in the art to which this technology belongs.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within the range.

Although the present technology has been described in detail, it should be understood that various changes, substitutions, and alterations can be made hereupon without departing from the principle and scope of the technology. Accordingly, the scope of the present technology should be determined by the following claims and their appropriate legal equivalents.

What is claimed is:

1. A loss mitigation bottom hole assembly for use in a wellbore in a severe loss zone of a formation, comprising:

a drill bit for drilling the wellbore;

a dual wall drill string connecting the drill bit to a fluid source, and having a first fluid passage for delivering fluid to the drill bit, and a separate second fluid passage for returning the fluid away from the drill bit; and a drilling liner circumscribing and attached to a portion of the dual wall drill string, and surrounding the drill bit while drilling, the drilling liner having an end adjacent the drill bit to contain the fluid exiting the drill bit and prevent the fluid from entering the severe loss zone of the formation.

2. The loss mitigation bottom hole assembly of claim 1, further comprising:

a liner running/setting tool for setting the drilling liner relative to a casing when the drilling liner reaches a desired location in the wellbore bridging the severe loss zone of the formation.

3. The loss mitigation bottom hole assembly of claim 2, wherein the liner running/setting tool further comprises:

a collet retainer nut circumscribing the dual wall drill string and moveable between a first position and a second position axially relative to the dual wall drill string;

a collet having an end coupled with the dual wall drill string, and a distal end engaged with the drilling liner when the collet retainer nut is in the first position, and selectively disengaged from the drilling liner when the collet retainer nut is in the second position;

a collet retainer nut activation mechanism controllable by an operator to move the collet retainer nut between the first position and the second position; a packer element circumscribing the drilling liner and in mechanical communication with the collet retainer nut, the packer element in an unenergized state when the collet retainer nut is in the first position, and in an energized state when the collet retainer nut is in the second position, so that when the collet retainer nut activation mechanism moves the collet retainer nut from the first position to the second position, the packer element is energized and seals the space between the drilling liner and the casing; and a toothed liner hanger slip circumscribing the drilling liner and in mechanical communication with the packer element, the toothed liner hanger slip disengaged from the casing when the packer element is not energized, and lockingly engaged with the casing when the packer element is energized, the toothed liner hanger slip preventing relative movement between the drilling liner and the casing when lockingly engaged with the casing.

4. The liner running/setting tool of claim 3, wherein the packer element has an angled surface positioned for forced insertion between the drilling liner and the toothed liner hanger slip when the packer element is energized, the angled surface pushing a portion of the toothed liner hanger slip into engagement with the casing when the packer element is energized.

5. The loss mitigation bottom hole assembly of claim 1, further comprising a fluid return area adjacent the drill bit between the dual wall drill string and the drilling liner, the fluid return area receiving fluid exiting from the drill bit; and a cross-over port assembly providing fluid communication between the fluid return area and the second fluid passage.

6. The loss mitigation bottom hole assembly of claim 5, wherein the cross-over port assembly comprises:

a valve having a first end and a second end, and movable between an open position and a closed position; and a passage between the fluid return area and the second fluid passage bisected by the valve;

the first end of the valve in pressure communication with the first fluid passage and the second and of the valve in pressure communication with the fluid return area, so that when pressure in the first fluid passage exceeds pressure in the fluid return area, the valve moves toward the open position.

7. A liner running/setting tool for setting a drilling liner relative to a casing adjacent a severe loss zone of a well comprising:

a collet retainer nut circumscribing a drill string in the well and moveable between a first position and a second position axially relative to the drill string;

a collet having an end coupled with the dual wall drill string, and a distal end engaged with the drilling liner when the collet retainer is in the first position, and selectively disengaged from the drilling liner when the collet retainer nut is in the second position;

a collet retainer nut activation mechanism controllable by an operator to move the collet retainer nut between the first position and the second position;

a packer element circumscribing the drilling liner and in mechanical communication with the collet retainer nut, the packer element in an unenergized state when the collet retainer nut is in the first position, and in an energized state when the collet retainer put is in the second position, so that when the collet retainer nut activation mechanism moves the collet retainer nut from the first position to the second position, the packer element is energized and seals the space between the drilling liner and the casing; and a toothed liner hanger slip circumscribing the drilling liner and in mechanical communication with the packer element, the toothed liner hanger slip disengaged from the casing when the packer element is not energized, and lockingly engaged with the casing when the packer element is energized, the toothed liner hanger slip preventing relative movement between the drilling liner, and the casing when lockingly engaged with casing.

8. The liner running/setting tool of claim 7, wherein the packer element has an angled surface positioned for forced insertion between the drilling liner and the toothed liner hanger slip when the packer element is energized, the angled surface pushing a portion of the toothed liner hanger slip into engagement with the casing when the packer element is energized.

9. The liner running/setting tool of claim 7, wherein the collet retainer nut activation mechanism is a pump that applies hydraulic pressure to a surface of the collet retainer nut to push the collet retainer nut from the first position toward the second position.

10. The liner running/setting tool of claim 7, further comprising:

a collet fixedly attached to the drill string, the collet fixedly engaged with the drilling liner when the collet retainer nut is in the first position, and releasably engaged with the drilling liner when the collet retainer nut is in the second position.

11. The liner running/setting tool of claim 7, further comprising:

a pressure equalization passage fluidly connecting an area above the liner running/setting tool with an area below the running/setting tool to equalize pressure above and below the running/setting tool.

12. The liner running/setting tool of claim 11, further comprising:

a check valve in the pressure equalization passage to open and close the pressure equalization passage to fluid communication.

13. A loss mitigation bottom hole assembly for use in a wellbore in a severe loss zone of a formation, comprising:

a drill bit for drilling the wellbore;

a dual wall drill string connecting the drill bit to a fluid source, and having a first fluid passage for delivering fluid to a drill bit, and a separate second fluid passage for returning the fluid away from the drill bit;

a drilling liner circumscribing and attached to a portion of the dual wall drill string, and surrounding the drill bit while drilling, the drilling liner having an end adjacent the drill bit to contain the fluid exiting the drill bit and prevent the fluid from entering the severe loss zone of the formation;

a fluid return area adjacent the drill bit between the dual wall drill string and the drilling liner, the fluid return area receiving fluid exiting from the drill bit; and a cross-over port assembly providing fluid communication between the fluid return area and the second fluid passage, the cross-over port assembly comprising:

a valve having a first end and a second end, and movable between an open position and a closed position; and a passage between the fluid return area and the second fluid passage bisected by the valve;

the first end of the valve in pressure communication with the first fluid passage and the second end of the valve in pressure communication with the fluid return area, so that when pressure in the first fluid passage exceeds pressure in the fluid return area, the valve moves toward the open position.

14. The loss mitigation bottom hole assembly of claim 13, wherein the cross-over port assembly further comprises:

a biasing mechanism in contact with the valve to bias the valve toward either the open or the closed position.

15. The loss mitigation bottom hole assembly of claim 13, wherein the passage of the cross-over port assembly between the fluid return area and the second fluid passage bisects the first fluid passage.

16. A method to control lost circulation in a severe loss zone in a subsurface formation the method comprising;

(a) drilling a wellbore in the subsurface formation using a first bottom hole assembly until the wellbore reaches the severe loss zone in the formation;

(b) removing the first bottom hole assembly from the wellbore;

(c) running a second bottom hole assembly into the wellbore, the second bottom hole assembly including a dual wall drill string, a drill bit, and a drilling liner extending to an end of the drill bit distal from the dual wall drill string;

(d) drilling through the severe loss zone using the second bottom hole assembly and positioning the drilling liner to extend to the end of the drill bit distal from the dual wall drill string, so that while drilling the drilling liner progresses through the severe loss zone along with the drill bit and prevents drilling fluid from entering the formation in the severe loss zone;

(e) removing the second bottom hole assembly from the wellbore.

17. The method of claim 16, further comprising directing drilling fluid diverted by the drilling liner into a cross over disposed in the dual wall drill string.

18. The method of claim 16, further comprising:

(f) setting the drilling liner relative to a casing in the wellbore above the severe loss zone prior to step (e).

19. The method of claim 16, further comprising:

(f) running the first bottom hole assembly into the well to continue boring the well below the severe loss zone.

20. A method to control lost circulation in a severe loss zone in a subsurface formation the method comprising;

(a) drilling a wellbore in the subsurface formation using a first bottom hole assembly until the wellbore reaches the severe loss zone in the formation;

(b) removing the first bottom hole assembly from the wellbore;

(c) running a second bottom hole assembly into the wellbore, the second bottom hole assembly including a dual wall drill string, a drill bit, and a drilling liner extending to an end of the drill bit distal from the dual wall drill string;

(d) drilling through the severe loss zone using the second bottom hole assembly and positioning the drilling liner to extend to the end of the drill bit distal from the dual wall drill string, so that while drilling the drilling liner progresses through the severe loss zone along with the drill bit and prevents drilling fluid from entering the formation in the severe loss zone;

(e) removing the second bottom hole assembly from the wellbore;

(f) setting the drilling liner relative to a casing in the wellbore above the severe loss zone prior to step (e); and (g) initiating step (f) by introducing a radio frequency identification (RFID) tag into the well to communicate with an RFID detector in the second bottom hole assembly.

* * * * *